US009826586B2

(12) United States Patent
Motomura et al.

(10) Patent No.: US 9,826,586 B2
(45) Date of Patent: Nov. 21, 2017

(54) POWER SUPPLY, LIGHTING SYSTEM, ILLUMINATING SYSTEM, AND METHOD FOR REDUCING A TIME REQUIRED FOR EXTINGUISHING AN ELECTRIC ARC

(71) Applicant: Panasonic Intellectual Property Management Co., Ltd., Osaka (JP)

(72) Inventors: Masashi Motomura, Osaka (JP); Hirofumi Konishi, Osaka (JP); Kenichi Fukuda, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/406,848

(22) Filed: Jan. 16, 2017

(65) Prior Publication Data

US 2017/0223790 A1 Aug. 3, 2017

(30) Foreign Application Priority Data

Feb. 1, 2016 (JP) ..... 2016-017399

(51) Int. Cl.
*H05B 33/08* (2006.01)

(52) U.S. Cl.
CPC ..... *H05B 33/0815* (2013.01); *H05B 33/0884* (2013.01)

(58) Field of Classification Search
CPC H05B 33/08; H05B 33/0815; H05B 33/0845; H05B 33/0851; H05B 33/0884; H05B 33/086; H05B 33/0866; H05B 33/0809
See application file for complete search history.

(56) References Cited

U.S. PATENT DOCUMENTS

2010/0225241 A1* 9/2010 Maehara ..... H05B 33/086 315/250
2011/0068714 A1* 3/2011 Komatsu ..... H05B 41/2886 315/307

FOREIGN PATENT DOCUMENTS

JP 2009-159653 A 7/2009

* cited by examiner

*Primary Examiner* — Thai Pham

(74) *Attorney, Agent, or Firm* — Renner Otto Boisselle & Sklar, LLP

(57) ABSTRACT

A power supply includes an input for receiving a first DC voltage, an output for outputting a second DC voltage, a voltage conversion circuit configured to convert the first DC voltage into the second DC voltage, and a control circuit configured to control the voltage conversion circuit to vary a voltage value of the second DC voltage. The control circuit is configured to control the voltage conversion circuit so as to decrease the voltage value of the second DC voltage from a first voltage value to a second voltage value for a predetermined duration every time a predetermined period elapses. The first voltage value is equal to or greater than a voltage value necessary to keep lighting a light source. The second voltage value is smaller than the voltage value necessary to keep lighting the light source.

15 Claims, 7 Drawing Sheets

POWER SUPPLY, LIGHTING SYSTEM, ILLUMINATING SYSTEM, AND METHOD FOR REDUCING A TIME REQUIRED FOR EXTINGUISHING AN ELECTRIC ARC

CROSS-REFERENCE TO RELATED APPLICATION

The present application is based upon and claims the benefit of priority of Japanese Patent Application No. 2016-017399, filed on Feb. 1, 2016, the entire contents of which are incorporated herein by reference.

TECHNICAL FIELD

The present disclosure relates to power supplies, lighting systems, illuminating systems, and methods for reducing a time required for extinguishing an electric arc.

BACKGROUND ART

JP 2009-159653 A discloses an illuminating system which includes an illuminating fixture electrically and directly connected to a DC line in a residence or an illuminating fixture electrically connected to a DC line through a wiring device such as a ceiling-mounted socket. Such DC lines each include two DC power supply paths, and are electrically connected to an AC/DC converter provided to a residential power distribution panel. Further, such illuminating fixtures each include a light source powered by a DC voltage to light (emit light) such as a light emitting diode (LED) or organic electroluminescence element. Since the illuminating fixture is powered by DC power supplied through the DC power supply paths, the illuminating fixture need not include a power supply circuit such as an AC/DC converter for converting an AC voltage into a DC voltage.

In the conventional illuminating system described above, detaching the illuminating fixture from the DC power supply paths under live-line state (which is energized) may cause an electric arc between a conductor of the DC power supply paths and an input terminal of the illuminating fixture. To extinguish the electric arc is more difficult for the conventional illuminating system than for an illuminating system that receives an AC voltage.

SUMMARY

An objective of the present disclosure is to provide a power supply, a lighting system, an illuminating system and a method capable reducing a time required for extinguishing an electric arc.

A power supply according to an aspect of the present disclosure is for supplying power to light a light source, and includes an input for receiving a first DC voltage; an output for outputting a second DC voltage; a voltage conversion circuit configured to convert the first DC voltage into the second DC voltage; and a control circuit configured to control the voltage conversion circuit to vary (adjust) a voltage value of the second DC voltage. The control circuit is configured to control the voltage conversion circuit so as to decrease the voltage value of the second DC voltage from a first voltage value to a lower limit value for a predetermined duration every time a predetermined period elapses. The first voltage value being equal to or greater than a voltage value necessary to keep lighting the light source, and the lower limit value is smaller than the voltage value necessary to keep lighting the light source.

A lighting system according to another aspect of the present disclosure includes the power supply, and a lighting device configured to light the light source by the second DC voltage supplied from the power supply. The lighting device includes a constant current circuit configured to adjust a lighting current to be supplied to the light source, to a predetermined desired value.

A lighting system according to another aspect of the present disclosure includes the power supply; a lighting device configured to light the light source by the second DC voltage supplied from the power supply; and a receiver circuit configured to obtain the transmission data by detecting change in the voltage value of the second DC voltage. The lighting device is configured to change a state of the light source according to the transmission data received from the receiver circuit.

An illuminating system according to another aspect of the present disclosure includes the lighting system; and the light source to be lit by the lighting device.

An illuminating system according to another aspect of the present disclosure includes the power supply; and a plurality of the illuminating fixtures. Each of the plurality of the illuminating fixtures includes a light source, and a lighting device configured to light the light source by the second DC voltage supplied from the power supply.

A method according to another aspect of the present disclosure is for reducing a time required for extinguishing an electric arc which can occur when detaching an illuminating fixture from a DC power supply path under a live-line state. The method includes: converting a first DC voltage into a second DC voltage; supplying the second DC voltage to the DC power supply path; and decreasing a voltage value of the second DC voltage from a first voltage value to a lower limit value for a predetermined duration every time a predetermined period elapses. The first voltage value is equal to or greater than a voltage value necessary to keep lighting a light source included in the illuminating fixture. The lower limit value being smaller than the voltage value necessary to keep lighting the light source included in the illuminating fixture.

The power supply, the lighting system, the illuminating system and the method according to the above aspects of the present disclosure can reduce a time required for extinguishing an electric arc.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

Hereinafter, a power supply, a lighting system, an illuminating system and a method of embodiments according to the present disclosure are described in detail with reference to the attached drawings. The embodiments described below relate to a power supply that decreases a DC output voltage periodically, and a lighting system including the power supply and a lighting device for lighting a light source. Further, the embodiments described below relate to an illuminating fixture including the power supply, the lighting device, and the light source. Additionally, the embodiments described below relate to an illuminating system including the power supply, the lighting device, and the light source, and an illuminating system in which a plurality of the illuminating fixtures are electrically connected in parallel to the power supply. The embodiments described below also relate to a method employed in the power supply, the lighting system, and the illuminating system. Note that, the embodiments described below are merely some of possible embodiments of the present disclosure, and may be modified according to design or the like.

Figure 1:
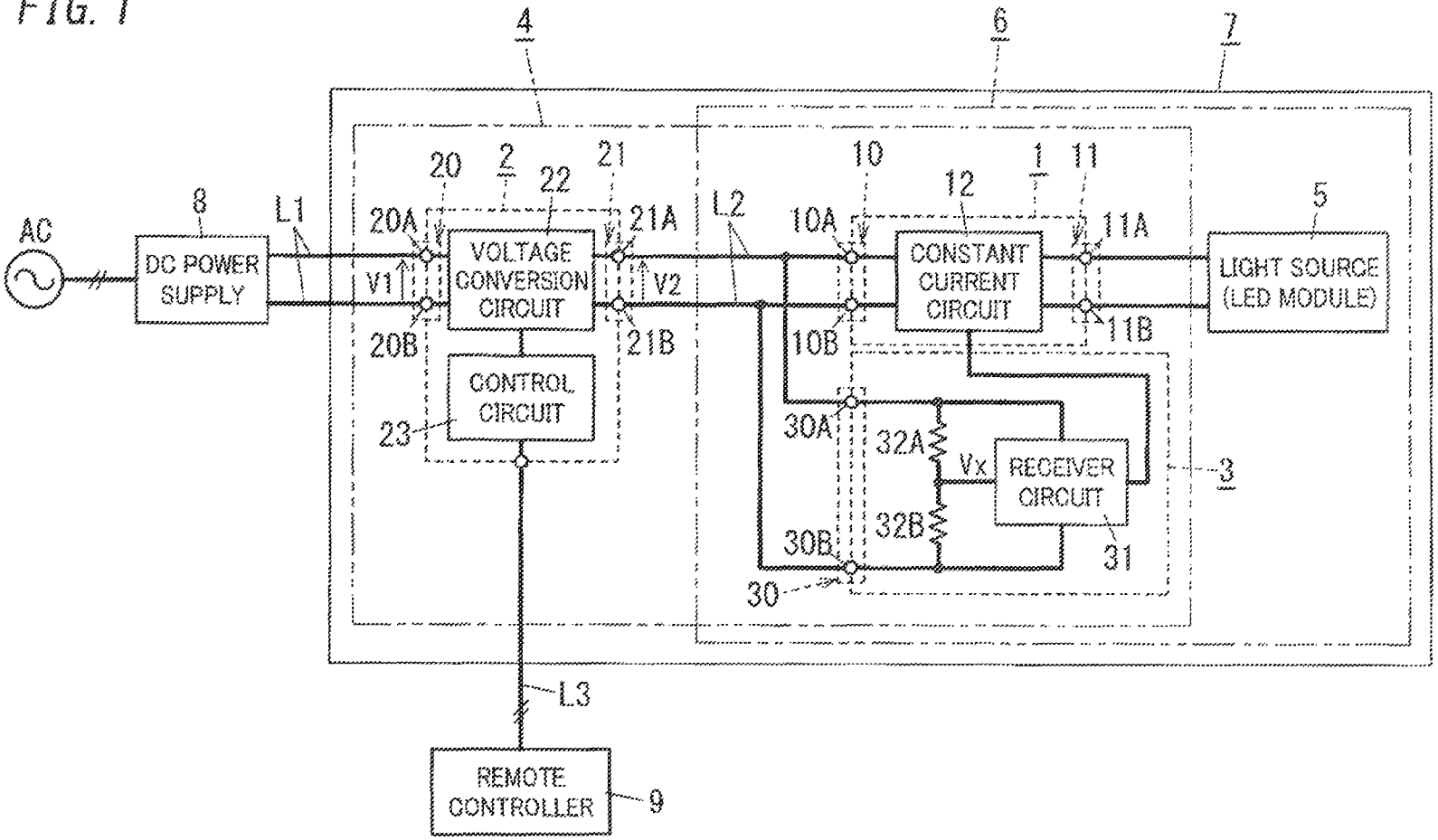
FIG. 1 is a block diagram of a power supply, a lighting system, an illuminating fixture, and an illuminating system of one embodiment according to the present disclosure.

As shown in FIG. 1, a lighting system 4 includes a lighting device 1, and a power supply 2. Preferably, the lighting system 4 further includes a signal receiving device 3. Note that, preferably, the lighting system 4 may be installed in a living room of a residence, but may be installed in an office of a business place, store premises, or the like.

The power supply 2 includes an input (power supply-side input) 20, an output (power-supply-side output) 21, a voltage conversion circuit 22, and a control circuit 23. The input 20 includes a first input terminal 20A and a second input terminal 20B. Preferably, the first and second input terminals 20A and 20B may include screw terminals or quick connection terminals, for example. The input 20 is electrically connected to a first power supply path L1 and thus can receive a DC voltage (a first DC voltage V1) through the first power supply path L1. The first power supply path L1 includes two electric wires. A first one of the two electric wires electrically connects the first input terminal 20A and a positive electrode side-output terminal of the DC power supply 8. A second one of the two electric wires electrically connects the second input terminal 20B and a negative electrode side-output terminal of the DC power supply 8.

The DC power supply 8 converts an AC voltage supplied from a power system AC into a DC voltage and outputs the resultant DC voltage to the first power supply path L1 through the -positive and negative electrode-side output terminals. The AC voltage supplied from the power system AC may have an effective value of 100 [V], and a power supply frequency of 50 [Hz] or 60 [Hz], for example. The DC voltage outputted from the DC power supply 8 may have a rated value in a range of 30 [V] to 40 [V], for example. The DC power supply 8 may include an input filter, a full-wave rectifier, and a DC/DC converter such as a power factor improvement circuit and a step-down chopper circuit, for example. Preferably, the DC power supply 8 may be placed inside a power distribution panel for indoor wiring such as a residential power distribution panel. However, the above described configuration of the DC power supply 8 is merely an example. Alternatively, the DC power supply 8 may increase or decrease a DC voltage supplied from a photovoltaic power system and thus output a resultant voltage to the first power supply path L1, for example. Note that, when the DC power supply 8 is not used, the power supply 2 may itself include an AC/DC converter for converting an AC voltage supplied from the power system AC into a DC voltage.

Figure 2A:
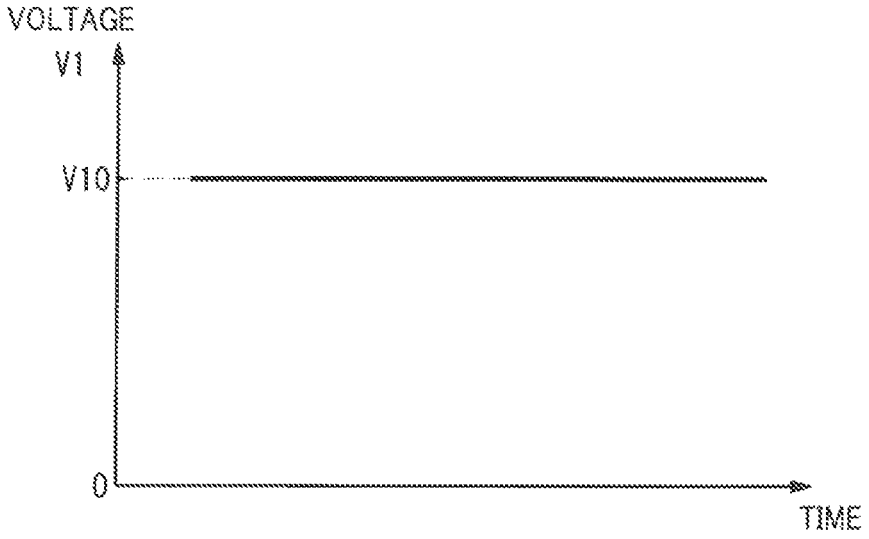
FIG. 2A is a waveform chart of a first DC voltage inputted into the power supply.
Figure 2B:
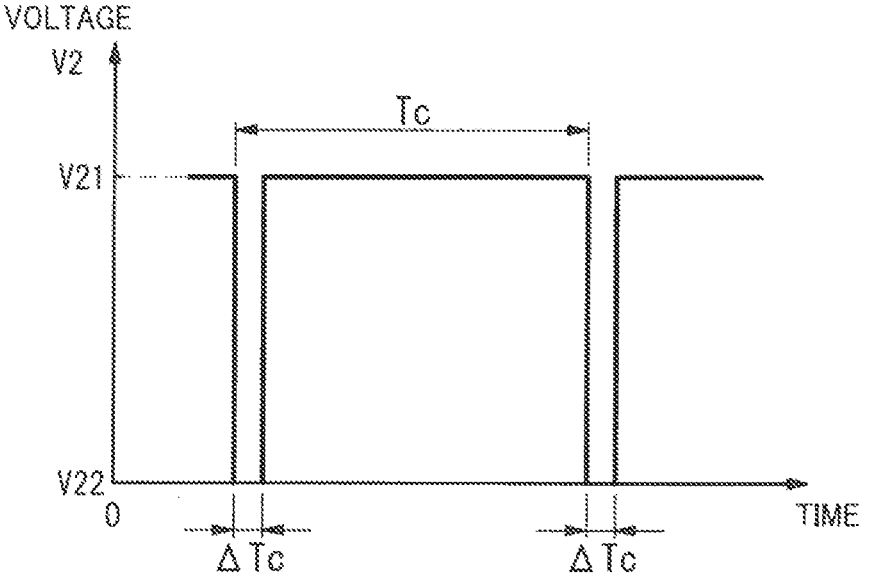
FIG. 2B is a waveform chart of a second DC voltage outputted from the power supply.

Further, the voltage conversion circuit 22 of the power supply 2 is configured to convert the first DC voltage V1 received by the input 20 into a second DC voltage V2 (as shown in FIG. 2A and FIG. 2B). The second DC voltage V2 is outputted from the output 21 to a second power supply path L2. The output 21 includes a first output terminal 21A and a second output terminal 21B. Preferably, the first and second output terminals 21A and 21B may include screw terminals or quick connection terminals, for example. The output 21 is electrically connected to the second power supply path L2 and thus can output the second DC voltage V2 to the second power supply path L2. The second power supply path L2 includes two electric wires. A first one of the two electric wires has a first end electrically connected to the first output terminal 21A. A second one of the two electric wires has a first end electrically connected to the second output terminal 21B.

The voltage conversion circuit 22 may preferably include a variable three-terminal regulator with a variable output voltage, for example. In detail, the voltage conversion circuit 22 is controlled by the control circuit 23 so that a voltage value of the second DC voltage V2 can be switched between a first voltage value V21 and a second voltage value V22. The first voltage value V21 is equal to or greater than a voltage value necessary for the lighting the lighting device 1 to turn on (light) a light source 5. Preferably, the first voltage value V21 may be a rated value of the second DC voltage V2 (rated value of the output voltage of the power conversion circuit 22). Note that, the first voltage value V21 may be equal to or different from a rated voltage value V10 of the first DC voltage V1. Additionally, the second voltage value V22 may be less than the voltage value necessary for the lighting device 1 to turn on (light) the light source 5, and may be 0 [V] (see FIG. 2B). Alternatively, the voltage conversion circuit 22 may include a switching regulator instead of a variable three-terminal regulator. The variable three-terminal regulator can only decrease an input voltage, whereas the switching regulator can decrease an input voltage and alternatively can increase or increase and decrease an input voltage. For this reason, when the voltage value of the second DC voltage V2 is set to be higher than the voltage value of the first DC voltage V1, it is preferable that the voltage conversion circuit 22 may include a step-up switching regulator.

The control circuit 23 may include a microcomputer or a control IC. The control circuit 23 is configured control the voltage conversion circuit 22 so as to switch the voltage value of the second DC voltage V2 from the first voltage value V21 to the second voltage value V22 (equal to 0 [V]) for a short duration ΔTc every time a time measured by a built-in timer of the microcomputer or control IC reaches a constant period Tc (see FIG. 2B). The period Tc may be 1 [s] or less, and 8.3 [ms] or more, for example. The duration ΔTc may be 0.1 [s] or less, and 0.83 [ms] or more. For example, the period Tc may be about 10 [ms] preferably, and the duration ΔTc may be about 1 [ms] preferably.

Figure 3:
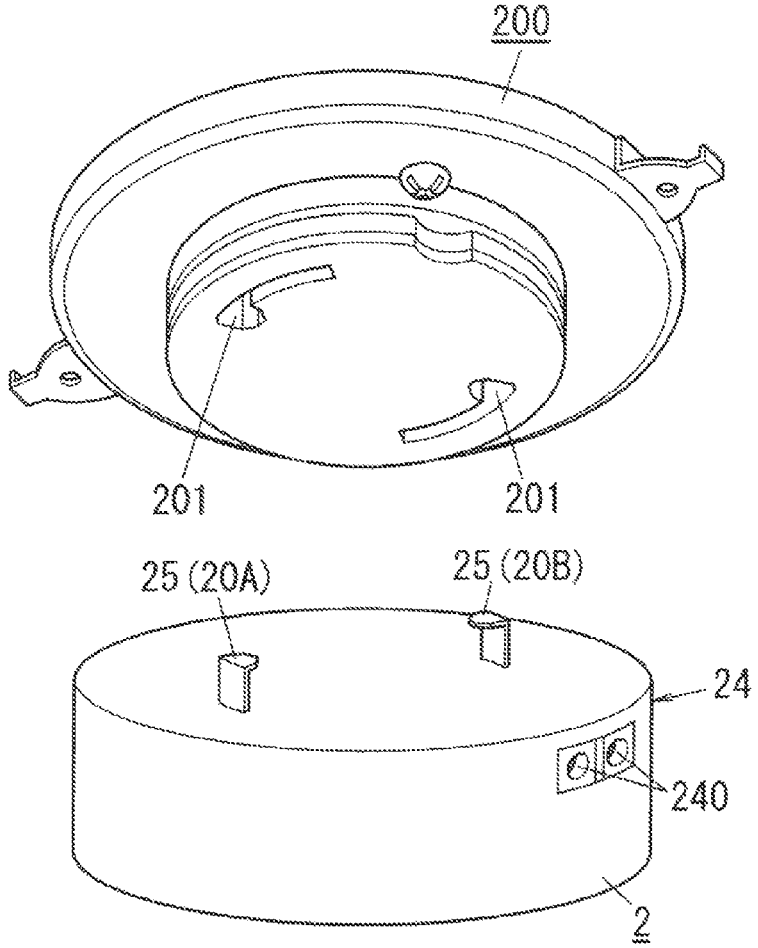
FIG. 3 is a perspective view of the power supply and a ceiling-mounted socket.

Note that, the first power supply path L1 may be electrically connected to a wiring device for delivering the power supply. For example, the wiring device for delivering the power supply may be a ceiling-mounted socket 200 installed in a ceiling (a finishing material of ceilings) of a residence (see FIG. 3). The ceiling-mounted socket 200 is electrically connected to the first power supply path L1 which may be preliminarily installed above the ceiling and thus is supplied with DC power from the DC power supply 8 through the first power supply path L1. As shown in FIG. 3, the power supply 2 includes a housing 24 in a hollow circular cylindrical shape. Preferably, the housing 24 may be made of material with electrically insulating properties such as synthetic resin, for example. There is a pair of hooking-blades 25 protruding from an upper face of the housing 24. By engaging the pair of hooking-blades 25 with hooking-blade receivers 201 of the ceiling-mounted socket 200, the power supply 2 is mechanically and electrically connected to the ceiling-mounted socket 200. In summary, the pair of hooking-blades 25 serves as the first and second input terminals 20A and 20B of the input 20. The housing 24 accommodates a pair of quick connection terminals, and this pair of quick connection terminals electrically connects the first and second output terminals 21A and 21B of the output 21 of the power supply 2 to the second power supply path L2. Note that, the housing 24 includes at its outer periphery a pair of electric wire insertion holes 240 for allowing connection of electric wires to the pair of quick connection terminals.

As shown in FIG. 1, the lighting device 1 includes a lighting-side input 10, a lighting-side output 11, and a constant current circuit 12. The lighting-side input 10 includes a first input terminal 10A and a second input terminal 10B. Preferably, the first and second input terminals 10A and 10B may include screw terminals or quick connection terminals, for example. The lighting-side input 10 is electrically connected to the second power supply path L2 and thus can receive the second DC voltage V2 through the second power supply path L2. The first input terminal 10A is electrically connected to the first one, which is electrically connected to the first output terminal 21A of the power supply 2, of the two electric wires constituting the second power supply path L2. The second input terminal 10B is electrically connected to the second one, which is electrically connected to the second output terminal 21B of the power supply 2, of the two electric wires constituting the second power supply path L2.

The lighting-side output 11 includes a first output terminal 11A and a second output terminal 11B. Preferably, the first and second output terminals 11A and 11B may include screw terminals or quick connection terminals, for example. The lighting-side output 11 is electrically connected to the light source 5. For example, the light source 5 includes one or more LED modules. The LED module may include a mounting substrate, one or more LED chips mounted on one surface of the mounting substrate, and an encapsulating member for encapsulating the one or more LED chips, for example. The encapsulating member may be made of light transmissive encapsulating material such as silicone resin. Note that, the LED chip may be a blue LED chip for emitting blue light, and the encapsulating material contains phosphor for converting blue light into yellow light. In summary, the LED module is designed to emit white light obtained by mixing the blue light with the yellow light. Note that, the light source 5 is not limited to one or more LED modules, but may be a straight LED lamp or an organic electroluminescence element, for example.

The first output terminal 11A is electrically connected to a positive electrode of the light source 5 (an anode electrode of an LED module). The second output terminal 11B is electrically connected to a negative electrode of the light source 5 (a cathode electrode of an LED module). The constant current circuit 12 includes a DC/DC converter such as a switching regulator and a series regulator. For example, when a rated voltage value (the first voltage value V21) of the second DC voltage V2 inputted from the power supply 2 into the lighting-side input 10 is higher than a rated voltage of the light source 5, the constant current circuit 12 may preferably include a step-down chopper circuit. Alternatively, when the first voltage value V21 is lower than the rated voltage of the light source 5, the constant current circuit 12 may preferably include a step-up chopper circuit. In the present embodiment, the rated voltage value of the second DC voltage V2 is higher than the rated voltage of the light source 5, and accordingly the constant current circuit 12 includes a step-down chopper circuit.

Figure 4:
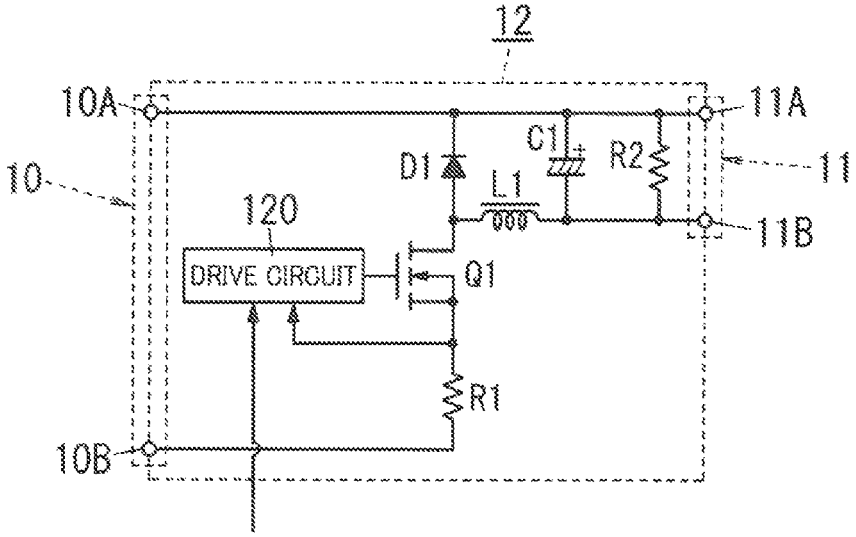
FIG. 4 is a circuit diagram of a constant current circuit in a lighting device of the lighting system.

As shown in FIG. 4, the constant current circuit 12 includes a step-down chopper circuit and a drive circuit 120 for driving the step-down chopper circuit. In the step-down chopper circuit, a cathode of a diode D1 is electrically connected to the first input terminal 10A, and a series circuit of a switching element Q1 and a resistor R1 is disposed between an anode of the diode D1 and the second input terminal 10B. An electrolytic capacitor as a smoothing capacitor C1 and an inductor L1 are electrically connected in series between the cathode and the anode of the diode D1. A resistor R2 for discharge is electrically connected between both ends of the smoothing capacitor C1. The light source 5 is electrically connected between the first output terminal 11A and the second output terminal 11B of the lighting-side output 11. The drive circuit 120 is configured to turn on and off the switching element Q1 with a high frequency. In detail, the drive circuit 120 is configured to detect magnitude of a current flowing through the switching element Q1 based on a voltage across the resistor R1, and to turn off the switching element Q1 when the magnitude of the current reaches a desired value. Additionally, the drive circuit 120 is configured to turn on the switching element Q1 at a constant period or when a current flowing through the inductor L1 reaches zero. With the drive circuit 120 turns on and off the switching element Q1 as the above mentioned manner, it is possible to make the magnitude of the current supplied to the light source 5 equal to a desired value. Preferably, when the desired value is changed, the constant current circuit 12 increases or decreases the output current so as to turn off (be extinguished), light at rated power, or light at given power the light source 5.

Hereinafter, operations of the power supply 2 and the lighting device 1 are described. The power supply 2 converts the first DC voltage V1 received through the input 20 into the second DC voltage V2 by use of the voltage conversion circuit 22, and outputs the resultant second DC voltage V2 to the second power supply path L2 through the output 21. The lighting device 1 receives the second DC voltage V2 from the second power supply path L2 through the lighting-side input 10 and reduces the received second DC voltage V2 by use of the constant current circuit 12, and supplies the resultant DC voltage to the light source 5 through the lighting-side output 11 to thereby light the light source 5. It is assumed a case where the light source 5 is detached from the lighting-side output 11 of the lighting device 1 under the live-line state. Note that, the live-line state means a state where the power supply 2 outputs the second DC voltage V2 and thus the lighting-side output 11 of the lighting device 1 receives the DC voltage.

When the light source 5 is detached from the lighting-side output 11 of the lighting device 1 under the live-line state, an electric arc may be formed between the first output terminal 11A or the second output terminal 11B of the lighting-side output 11 and the pair of electrodes of the light source 5. Since the DC voltage does not have zero crossing differently from the AC voltage, the electric arc may continue while the light source 5 is near the lighting-side output 11.

However, in the power supply 2, the control circuit 23 controls the voltage conversion circuit 22 to switch the voltage value of the second DC voltage V2 from the first voltage value V21 to the second voltage value V22 at the constant period Tc (see FIG. 2B). When the voltage value of the second DC voltage V2 transmitted from the power supply 2 is switched to the second voltage value V22, the voltage between the first output terminal 11A and the second output terminal 11B of the lighting-side output 11 becomes approximately zero, and as a result the electric arc is extinguished. Therefore, the power supply 2 can reduce a time required for extinguishing the electric arc in comparison with a case where the voltage value of the second DC voltage V2 is not switched from the first voltage value V21 to the second voltage value V22 periodically. It should be noted that the second voltage value V22 is not limited to 0 [V]. It is sufficient that the second voltage value V22 may be a value smaller than a voltage value necessary for the light source 5 to keep lighting. Consequently, since the light source 5 is turned off (extinguished), a time required for extinguishing an electric arc can be reduced.

As described above, the power supply 2 includes the input 20 for receiving the first DC voltage V1, the output 21 for outputting the second DC voltage V2, the voltage conversion circuit 22 configured to convert the first DC voltage V1 into the second DC voltage V2, and the control circuit 23 configured to control the voltage conversion circuit 22 to change a voltage value of the second DC voltage V2. The control circuit 23 is configured to control the voltage conversion circuit 22 so as to decrease the voltage value of the second DC voltage V2 to a lower limit value (the second voltage value V22) for a predetermined duration ΔTc every time a predetermined period Tc elapses. The lower limit value (the second voltage value V22) is smaller than a voltage value necessary for the light source 5 to keep lighting with the second DC voltage V2.

The power supply 2 with the above described configuration can reduce a time required for extinguishing an electric arc that would be caused by detaching the light source 5 under the live-line state, because the voltage value of the second DC voltage V2 is decreased to the lower limit value.

As described above, the lighting system 4 includes the power supply 2, and the lighting device 1 configured to light the light source 5 by the second DC voltage V2 supplied from the power supply 2. The lighting device 1 includes the constant current circuit 12 configured to adjust a lighting current to be supplied to the light source 5, to a predetermined desired value.

The lighting system 4 with the above described configuration can reduce a time required for extinguishing an electric arc that is formed by detaching the light source 5 under the live-line state, because the voltage value of the second DC voltage V2 is decreased to the lower limit value.

In the lighting system 4, preferably, the lighting device 1 includes the first output terminal 11A to be electrically connected to the positive electrode of the light source 5, and the second output terminal 11B to be electrically connected to the negative electrode of the light source 5. Preferably, the constant current circuit 12 includes the smoothing capacitor C1 electrically connected between the first and second output terminals 11A and 11B.

In the lighting system 4 with the above described configuration, the output voltage of the lighting device 1 can be averaged by the smoothing capacitor C1. Accordingly, it is possible to suppress the decrease in the light output of the light source 5 in the duration ΔTc during which the voltage value of the second DC voltage V2 is reduced.

In the lighting system 4, preferably, the constant current circuit 12 includes the reverse-flow preventer (the diode D1) for limiting a direction of a flow of a discharge current from the smoothing capacitor C1 so that the discharge current is outputted from the constant current circuit 12 through the first output terminal 11A and returns to the constant current circuit 12 through the second output terminal 11B.

In the lighting system 4 with the above described configuration, the discharge current from the smoothing capacitor C1 flows to the light source 5 only. As a result, it is possible to further suppress the decrease in the light output of the light source 5 in the duration ΔTc during which the voltage value of the second DC voltage V2 is reduced.

Incidentally, the control circuit 23 of the power supply 2 may be configured to receive a control signal transmitted from a remote controller 9 through a signal line L3 (see FIG. 1). Additionally, the control circuit 23 may be configured to convert a light level indicated by the control signal received into transmission data, and control the voltage conversion circuit 22 according to the transmission data. Note that, the light level is defined as a value ([%]) representing in percentage terms, and is a ratio of a current supplied to the light source 5 to a rated value. The transmission data may be constituted by a sequence of 8 bits representing up to 256 values individually associated with 256 light levels, for example. For example, the light level of 100[%] is associated with (converted into) a sequence of bits of "00000000". The light level of 0[%] (turning off, extinguishing) is associated with (converted into) a sequence of bits of "11111111". The light level of 50[%] is associated with (converted into) a sequence of bits of "10000000". Note that, the number of light levels may not necessarily be 256, but may be 128, 512, or one or more to twenty or less levels, for example.

Figure 5:
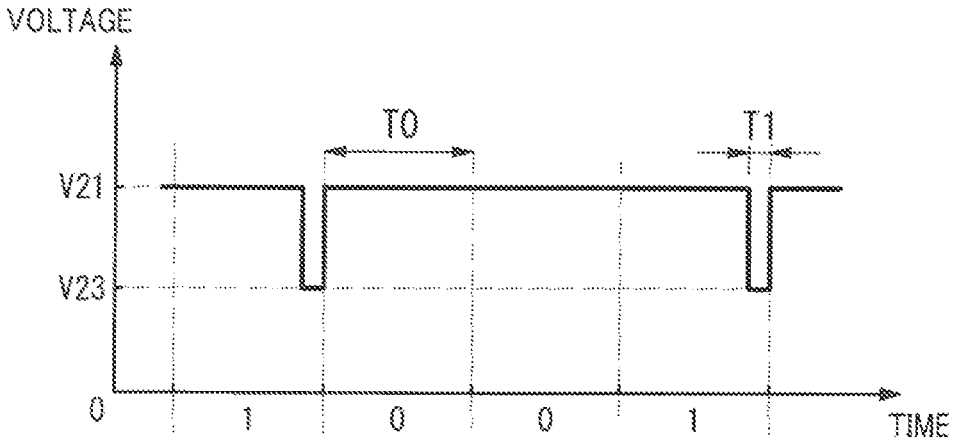
FIG. 5 is a waveform chart of a transmission signal transmitted from the power supply.

For example, when a given one of bits of the transmission data has "1", the control circuit 23 controls the voltage conversion circuit 22 so as to change (adjust) the voltage value of the second DC voltage V2 to a third voltage value V23 smaller than the first voltage value V21 (see FIG. 5). In contrast, when a given one of bits of the transmission data has "0", the control circuit 23 controls the voltage conversion circuit 22 so as to change (adjust) the voltage value of the second DC voltage V2 to the first voltage value V21 (see FIG. 5). In detail, the control circuit 23 is configured to define a transmission period for transmitting the transmission data of 8 bits as eight time slots having a constant time width T0 (see FIG. 5). When a given one of bits of the transmission data has "1", the control circuit 23 controls the voltage conversion circuit 22 so that the voltage value of the second DC voltage V2 is kept changed to the third voltage value V23 within a time duration T1 shorter than the time width T0 of the time slot (see FIG. 5). Note that, the control circuit 23 controls the voltage conversion circuit 22 so that an end timing of the time slot coincides with a rising edge of the second DC voltage V2 (timing of an increase from the third voltage value V23 to the first voltage value V21). However, it is sufficient that the control circuit 23 may change the voltage value of the second DC voltage V2 to the third voltage value V23 within a given period in the time slot. For example, the control circuit 23 may control the voltage conversion circuit 22 so that a start timing of the time slot coincides with a falling edge of the second DC voltage V2 (timing of a decrease from the first voltage value V21 to the third voltage value V23). Preferably, the third voltage value V23 is a value equal to or larger than a voltage value necessary for the lighting device 1 to light the light source 5.

In this regard, the control circuit 23 may control the voltage conversion circuit 22 to send a start bit indicating start of the transmission period prior to a first bit of the transmission data and send a stop bit indicating end of the transmission period subsequent to a last bit of the transmission data. For example, the start bit may be a sequence of bits of "111", and the stop bit may be a sequence of bits of "000". Note that, the transmission data has a fixed length of 8 bits. For this reason, even when the stop bit is not transmitted from a transmitter side (the power supply 2), a receiver side (the signal receiving device 3) can still determine whether the transmission period has ended. Note that, in the present embodiment, a signal transmitted by switching a voltage between wires of the power supply path L2 (the second DC voltage V2) between the first voltage value V21 and the third voltage value V23 within the transmission period is named as a transmission signal. The transmission signal may include the start bit, the transmission data, and the stop bit, but may not include the stop bit if necessary. Further, the control circuit 23 is configured to, in a period other than the transmission period and every elapse of the period Tc, control the voltage conversion circuit 22 so as to keep the voltage value of the second DC voltage V2 equal to the first voltage value V21.

Figure 6:
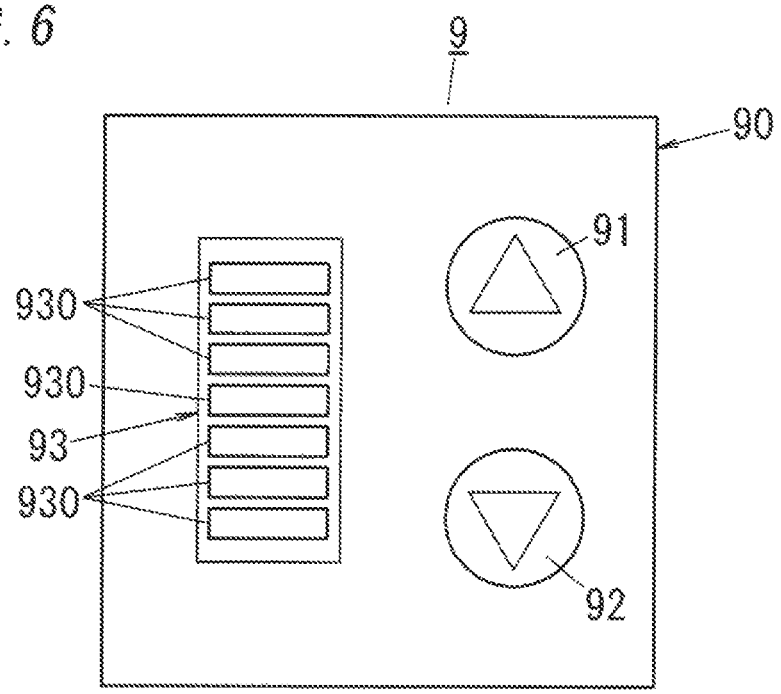
FIG. 6 is a front view of a remote controller used together with the lighting system of one embodiment according to the present disclosure.

As shown in FIG. 6, the remote controller 9 includes a body 90 of a synthetic resin molded product. The body 90 is attached to a wall so that part (mainly, a rear part) of the body 90 is inserted into a recess created in a wall material, for example. Additionally, the remote controller 9 includes a first manual operation button 91, a second manual operation button 92, and a display 93. The first manual operation button 91 is exposed on a front face of the body 90. The second manual operation button 92 is exposed on the front face of the body 90 so as to be beneath the first manual operation button 91. The display 93 includes seven display elements (e.g., light emitting diodes) 930 arranged in a line along a vertical direction. The display 93 is configured to light a predetermined number of seven display elements 930 according to the light level which is set by a user pushing the first manual operation button 91 and the second manual operation button 92.

When the first manual operation button 91 is pushed, the remote controller 9 increases the light level from a value immediately before the first manual operation button 91 is pushed, and sends through the signal line L3 a light level control signal indicative of the light level increased. In contrast, when the second manual operation button 92 is pushed, the remote controller 9 decreases the light level from a value immediately before the first manual operation button 91 is pushed, and sends through the signal line L3 a light level control signal indicative of the light level decreased. Additionally, the remote controller 9 lights the uppermost display element 930 when the light level is 100[%], and lights a lower display element 930 as the light level becomes lower. Hence, a person operating the remote controller 9 can roughly perceive the light level by checking which one of the display elements 930 of the display 93 lights. Note that, a device used for controlling the light level of an illuminating fixture like the aforementioned remote controller 9 is also called a dimmer in some cases.

Preferably, the lighting system 4 includes the signal receiving device 3 (see FIG. 1). The signal receiving device 3 includes a receiver-side input 30, a receiver circuit 31, and a voltage dividing circuit (see FIG. 1). The receiver-side input 30 includes a pair of receiver-side input terminals 30A and 30B. Preferably, these receiver-side input terminals 30A and 30B may include screw terminals or quick connection terminals, for example. Note that, the receiver-side input terminals 30A and 30B of the receiver-side input 30 may be electrically connected, in the lighting device 1, to the first and second input terminals 10A and 10B of the lighting-side input 10, respectively. Additionally, a printed circuit serving as the constant current circuit 12 of the lighting device 1 and a printed circuit serving as the receiver circuit 31 and the voltage dividing circuit of the signal receiving device 3 may be formed on the same printed circuit board. The receiver-side input 30 is electrically connected to the second power supply path L2 and thus can receive the second DC voltage V2 through the second power supply path L2. The receiver-side input terminal 30A is electrically connected to the first output terminal 21A of the power supply 2 through the first one of the two electric wires constituting the second power supply path L2. The receiver side input terminal 30B is electrically connected to the second output terminal 21B of the power supply 2 through the second one of the two electric wires constituting the second power supply path L2.

As shown in FIG. 1, the voltage dividing circuit includes a series circuit of two resistors 32A and 32B. The voltage dividing circuit is electrically connected between the pair of receiver-side input terminals 30A and 30B. The voltage dividing circuit can output a voltage (a detection voltage Vx) divided from a voltage between electric wires of the second power supply path L2 (the second DC voltage V2) to the receiver circuit 31. The receiver circuit 31 may include a microcontroller or a control IC. The receiver circuit 31 samples the detection voltage Vx inputted from the voltage dividing circuit at a constant sampling period and stores it in a buffer memory. Note that, the sampling period is set to be shorter than the time duration T1 in which the power supply 2 transmits one bit of the transmission data.

The receiver circuit 31 compares the sampled value (a voltage value of the detection voltage Vx) stored in the buffer memory with a threshold value to thereby receive the transmission signal (the start bit, the transmission data, and the stop bit). In detail, when the sampled value falls below the threshold value, the receiver circuit 31 determines reception of a bit of "1" and then stores the bit ("1") in the buffer memory. When receiving the start bit, the receiver circuit 31 receives the transmission data transmitted subsequent to the start bit, and stores it in the buffer memory. When receiving the stop bit, the receiver circuit 31 finishes storing of data in the buffer memory.

The receiver circuit 31 obtains the light level from the transmission data stored in the buffer memory. Additionally, the receiver circuit 31 converts the obtained light level into a PWM signal, and then outputs it to the constant current circuit 12 of the lighting device 1. The receiver circuit 31 changes a duty cycle of a rectangular wave with a constant period according to the light level, thereby converting the light level into the PWM signal. For example, the receiver circuit 31 sets the duty cycle to 100[%] when the light level is 100[%], and sets the duty cycle to 0[%] when the light level is 0[%], and sets the duty cycle to 50[%] when the light level is 50[%]. Alternatively, the receiver circuit 31 may convert the light level into a voltage signal with a voltage value representing the light level.

In contrast, the constant current circuit 12 changes the desired value of the output current according to the PWM signal received from the receiver circuit 31. For example, when the duty cycle of the PWM signal is 100[%], the constant current circuit 12 sets the desired value of the output current to a rated value (a current value of a rated current of the light source 5). Further, when the duty cycle of the PWM signal is 50[%], the constant current circuit 12 sets the desired value of the output current to half of the rated value. Note that, when the duty cycle of the PWM signal is 0[%], the constant current circuit 12 ends outputting of the output current to turn off the light source 5.

Figure 7:
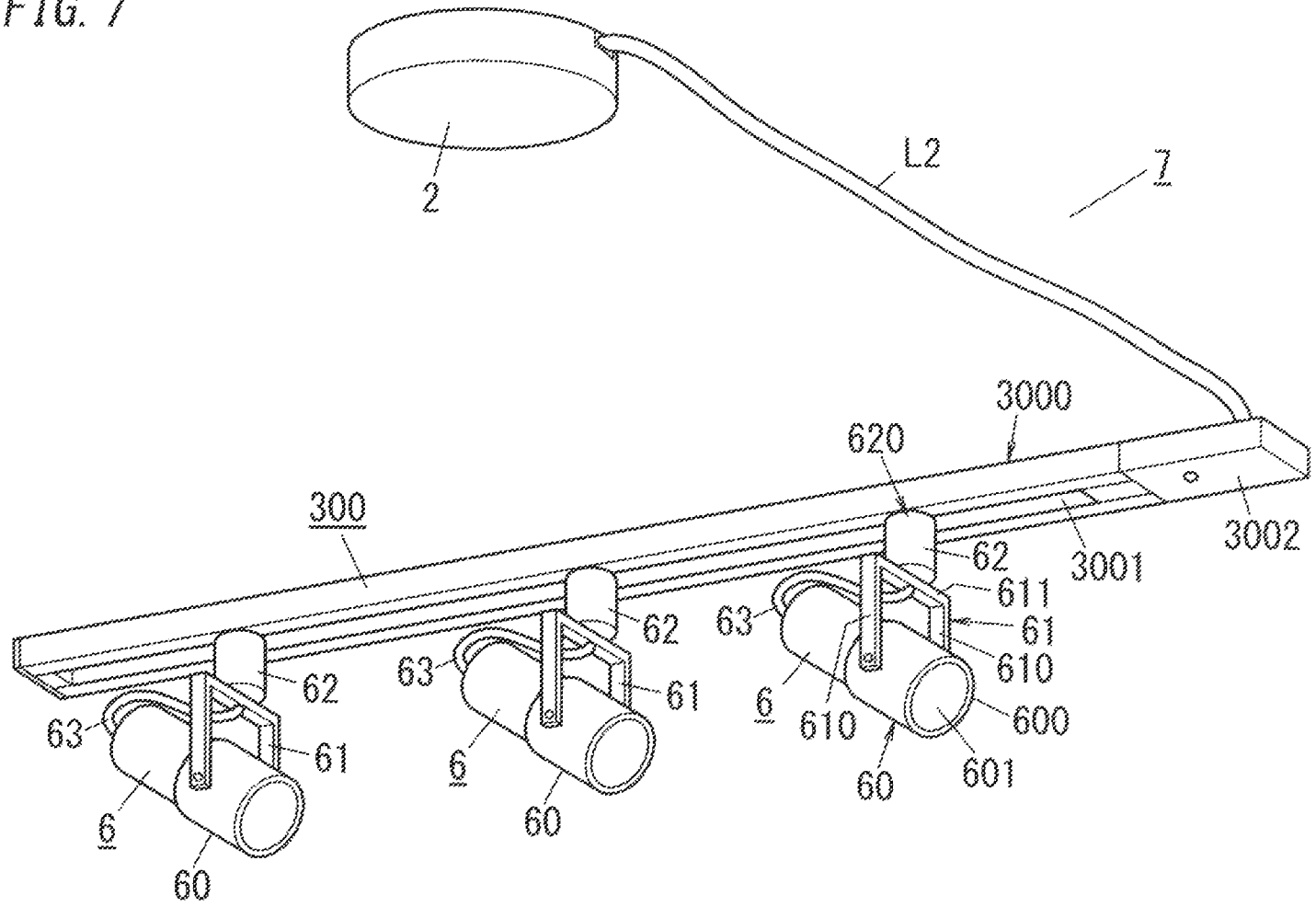
FIG. 7 is a system configuration diagram of an illuminating system of one embodiment according to the present disclosure.

Note that, the lighting device 1, the signal receiving device 3, and the light source 5 may be included in components of an illuminating fixture 6. For example, as shown in FIG. 7, the illuminating fixture 6 is a spotlight used in combination with a lighting duct for illuminating fixtures (hereinafter, referred to as "duct") 300. The duct 300 is attached to a ceiling (a lower face of a finishing material of ceilings). The duct 300 includes a duct body 3000 of synthetic resin, and two conductors (not shown) accommodated inside the duct body 3000. The duct body 3000 has a hollow elongated cuboidal shape. The duct body 3000 has at its lower face an insertion opening 3001 which has a straight shape extending along a lengthwise direction of the duct body 3000. The two conductors are fixed inside the duct body 3000 so as to be on opposite sides of the insertion opening 3001 when viewed from the lower side. Further, there is a feed-in unit 3002 electrically and mechanically connected to one end in the lengthwise direction of the duct body 3000. The feed-in unit 3002 electrically connects the two electric wires of the second power supply path L2 to the two conductors inside the duct body 3000 individually. Therefore, the duct 300 is supplied with the second DC voltage V2 from the power supply 2.

As shown in FIG. 7, the illuminating fixture 6 includes a body 60, an arm 61, and a plug 62. The body 60 is made of metal or synthetic resin. The body 60 has a shape that two hollow circular cylinders with different diameters are connected in their common axial direction. The body 60 accommodates inside the light source 5, the lighting device 1, and the signal receiving device 3. Note that, a printed circuit including the constant current circuit 12 of the lighting device 1 and a printed circuit including the receiver circuit 31 and the voltage dividing circuit of the signal receiving device 3 may be included in the same printed circuit board. The body 60 has one end facing the light source 5 and provided with a window hole 600. The window hole 600 is fitted with a panel 601 made of light transmissive material such as glass and acrylic resin. Light produced by the light source 5 is radiated to an illumination space through the panel 601. The plug 62 includes a plug body 620 with a hollow cylindrical shape, and a pair of electrode plates (not shown) protruding from an upper face of the plug body 620. The pair of electrode plates are inserted into the duct body 3000 via the insertion opening 3001 and then in contact with the two conductors fixed inside the duct body 3000 individually. Note that, the pair of electrode plates of the plug 62 are electrically connected to the first and second input terminals 10A and 10B of the lighting device 1 accommodated in the body 60 through an electric cable 63. The arm 61 includes a pair of supporting pieces 610 for supporting the body 60 and an interconnecting piece 611 for interconnecting the pair of supporting pieces 610. The arm 61 is attached at a center of the interconnecting piece 611 to the lower face of the plug body 620 in a rotatable manner within a horizontal plane. Further, the pair of supporting pieces 610 of the arm 61 is attached to opposite side faces of the body 60 in a rotatable manner within a vertical plane.

The illuminating fixture 6 is electrically and mechanically connected to the duct 300 through the plug 62. Hence, the illuminating fixture 6 lights with DC power supplied through the duct 300. Note that, an illuminating system 7 includes the power supply 2 and the illuminating fixture 6 (the light source 5, the lighting device 1, and the signal receiving device 3) (see FIG. 1). As shown in FIG. 7, the illuminating system 7 may include the power supply 2 and a plurality of the illuminating fixtures 6.

Incidentally, when the plug 62 of the illuminating fixture 6 is detached from the duct 300 under the live-line state, an electric arc may be formed between the electrode plate of the plug 62 and the conductor of the duct 300. However, this configuration can reduce a time required for extinguishing the electric arc, because the voltage value of the second DC voltage V2 is decreased to the lower limit value.

Hereinafter, operations of the lighting system 4 and the illuminating system 7 are described.

For example, a person is assumed to change the light level from 100[%] to 50 [%] by pushing the second manual operation button 92 of the remote controller 9. The remote controller 9 sends a light level control signal indicative of the light level of 50[%] through the signal line L3. When receiving the light level control signal from the remote controller 9, the control circuit 23 of the power supply 2 converts the light level (50[%]) indicated by the light level control signal into the transmission data (a sequence of 8 bits of "10000000"). Further, the control circuit 23 controls the voltage conversion circuit 22 so as to send the start bit first, then send the transmission data, and finally send the stop bit.

The transmission signal which is sent from the power supply 2 through the second power supply path L2 is received by the signal receiving devices 3 of all the illuminating fixtures 6 through the second power supply path L2 (including the conductors of the duct 300). The receiver circuit 31 of the signal receiving device 3 obtains the light level (50[%]) from the transmission data included in the transmission signal received, and further converts the light level obtained, into the PWM signal. In summary, the receiver circuit 31 generates the PWM signal with the duty cycle of 50[%], and outputs the PWM signal generated, to the constant current circuit 12 of the lighting device 1.

The constant current circuit 12 sets the desired value of the output current to half of the rated value according to the duty cycle (50[%]) of the PWM signal. Therefore, the current value of the output current outputted from the lighting-side output 11 of the lighting device 1 to the light source 5 becomes equal to half of the rated value. Accordingly, an amount of light (light flux) emitted from the light source 5 also becomes almost half of an amount of light produced by rated lighting. As a result, amounts of light of all the illuminating fixtures 6 connected to the duct 300 are each adjusted to half of the amount of light produced by rated lighting.

In a conventional illuminating system, a communication signal (the transmission signal) for data transmission that employs a high frequency carrier is superimposed on a DC voltage. However, in a case where the transmission signal generated by modulating the high frequency carrier is superimposed on the DC voltage like the case of the illuminating system, the indoor wiring is likely to act like an antenna to thus emits electromagnetic waves (considered to be noise), and the transmission signal (considered to be noise) is likely to be leaked to an adjacent residence through a power supply cable. In contrast, the power supply 2, the lighting system 4 and the illuminating system 7 vary the voltage value of the DC voltage (the second DC voltage V2) supplied through the second power supply path L2 to thereby send the transmission data (the light level). Therefore, the power supply 2, the lighting system 4 and the illuminating system 7 can offer a decrease in noise caused by transmission and reception of the transmission data compared with a case of superimposing the transmission signal generated by modulating the high frequency carrier on the DC voltage. Additionally, both the power supply 2 and the signal receiving device 3 need not include an oscillator for generating high frequency carriers, and thus circuit configuration thereof can be simplified.

Note that, the signal receiving devices 3 may have unique addresses. When the signal receiving devices 3 have unique addresses, the control circuit 23 of the power supply 2 may send a desired address bit indicative of an address following the start bit, and thereafter send the transmission data. When the address indicated by the address bit of the received transmission signal is identical to the unique address of the signal receiving device 3, the receiver circuit 31 of the signal receiving device 3 converts the light level obtained from the transmission data into the PWM signal and outputs the resultant PWM signal to the lighting device 1. In contrast, when the address indicated by the address bit is not identical to the unique address of the signal receiving device 3, the receiver circuit 31 does not obtain the light level from the transmission data and discards the transmission data. Allocating unique addresses to the signal receiving devices 3 in such a manner allows individual turning on (lighting) and off (extinguishing) and dimming a plurality of illuminating fixtures 6 connected to the duct 300.

Note that, the light source 5 may include multiple kinds of LED modules with different light emission colors. For example, the light source 5 may include a first LED module for emitting white light and a second LED module for emitting light of a light (lamp) color. Additionally, the lighting device 1 may preferably include a first constant current circuit for lighting the first LED module and a second constant current circuit for lighting the second LED module. The transmission data which indicates a first light level of the first LED module and a second light level of the second LED module is sent from the power supply 2 to the signal receiving device 3. The receiver circuit 31 of the signal receiving device 3 converts the first light level received from the power supply 2 into the PWM signal and outputs the resultant PWM signal to the first constant current circuit. Similarly, the receiver circuit 31 of the signal receiving device 3 converts the second light level received from the power supply 2 into the PWM signal and outputs the resultant PWM signal to the second constant current circuit. Accordingly, the first constant current circuit provides a current having a desired value corresponding to the PWM signal received from the receiver circuit 31, to the first LED module. The second constant current circuit provides a current having a desired value corresponding to the PWM signal received from the receiver circuit 31, to the second LED module. Therefore, the light source 5 emits light which is a mixture (or has a mixed color) of white light produced by the first LED module and light (lamp) color light produced by the second LED module. In summary, the illuminating fixture 6, the lighting system 4 and the illuminating system 7 can offer adjustment of a color of light of the light source 5 according to a ratio of the first light level to the second light level.

Note that, the transmission data is not limited to the light level. For example, when an illuminating fixture includes a speaker therein, the transmission data may be a sound (music) file. In this case, the power supply 2 may send the sound (music) file as the transmission data, and the speaker is operated based on the transmission data received by the signal receiving device 3. Thereby, the illuminating fixture can output a sound (music) by the speaker.

Note that, the power supply 2 does not necessarily include a structure electrically and mechanically connectable to the ceiling-mounted socket 200. For example, the power supply 2 may be placed above the ceiling while its components such as the voltage conversion circuit 22 and the control circuit 23 are accommodated in a case made of metal or synthetic resin. The power supply 2 may be configured so that the housing 24 incorporates the DC power supply 8. The second power supply path L2 electrically interconnecting the power supply 2 and the lighting device 1 does not necessarily include the duct 300. For example, the second power supply path L2 may be constituted by an electric cable (e.g., a vinyl insulated vinyl sheathed cable) installed above the ceiling. The illuminating fixture 6 may not be limited to a spotlight, but may be a downlight or a flat illuminating fixture which is attached to a wall face for indirect lighting. The lighting device 1 and the signal receiving device 3 may not be incorporated in the body of the illuminating fixture. For example, a case for accommodating the lighting device 1 and the signal receiving device 3 may be separate from the body of the illuminating fixture, and the lighting-side output 11 of the lighting device 1 and the light source 5 may be electrically interconnected by an electric cable. The remote controller 9 may be configured to send the light level control signal by use of a communication medium such as infrared and a radio wave, instead of the signal line L3.

Figure 8:
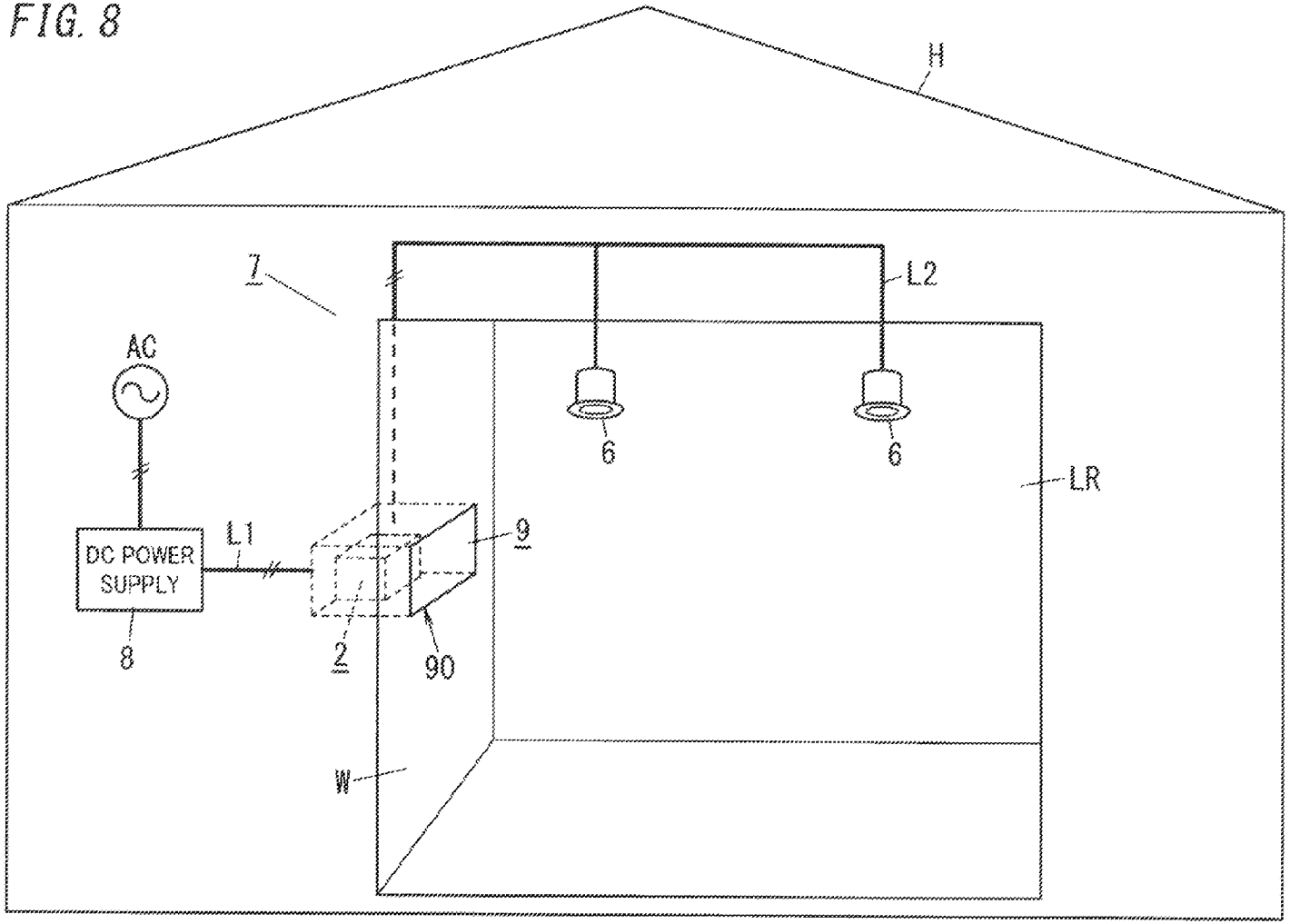
FIG. 8 is a system configuration diagram of a modification of the illuminating system.
Figure 9:
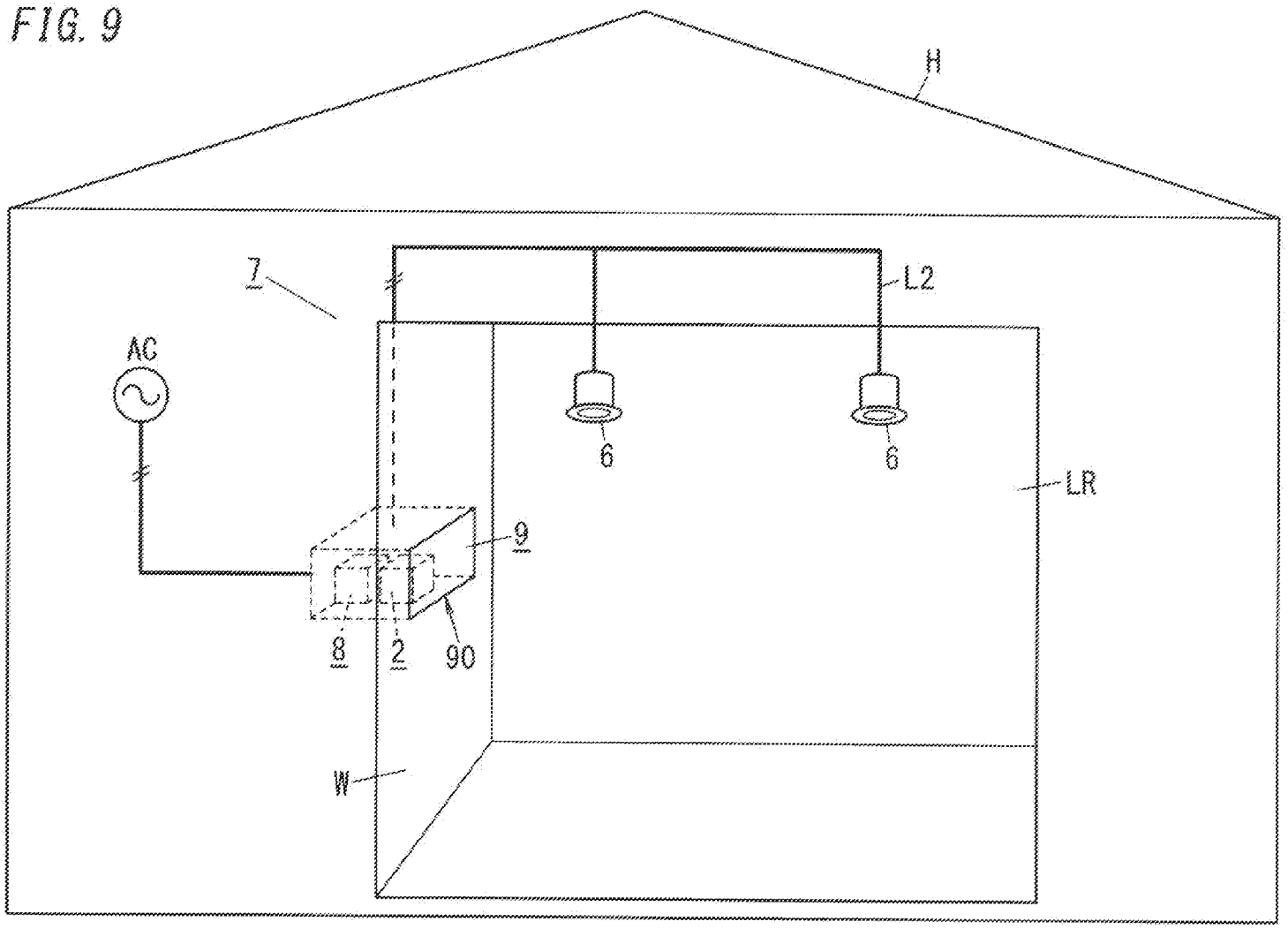
FIG. 9 is a system configuration diagram of another modification of the illuminating system.

Further, in the illuminating system 7, the power supply 2 may be accommodated in the body 90 of the remote controller 9, as shown in FIG. 8. Moreover, in the illuminating system 7, the power supply 2 and the DC power supply 8 may be accommodated in the body 90 of the remote controller 9, as shown in FIG. 9. The body 90 of the remote controller 9 is attached to a wall W of a living room LR of a residence H so that part (mainly, a rear part) of the body 90 is inserted into a recess created in the wall W (see FIG. 8 and FIG. 9). Note that, the remote controller 9 may include a touch panel instead of the first manual operation button 91 and the second manual operation button 92. The remote controller 9 may be configured to receive a wireless signal carried by infrared or a radio wave. This wireless signal may be sent from a wireless transmitter (not shown). The wireless transmitter may be configured to send, as the wireless signal, the control signal for indicating the light level.

As described above, in the power supply 2, preferably, the control circuit 23 is configured to control the voltage conversion circuit 22 so that the second DC voltage V2 has a voltage value which changes (the third voltage value V23) according to transmission data in a predetermined transmission period.

The power supply 2 with the above described configuration can transmit the transmission data by changing the voltage value of the second DC voltage V2, and thus can offer a decrease in noise which is potentially caused by transmission of the transmission data.

As described above, the lighting system 4 includes the power supply 2, the lighting device 1 configured to light the light source 5 by the second DC voltage V2 supplied from the power supply 2, and the receiver circuit 31 configured to obtain the transmission data by detecting change in the voltage value of the second DC voltage V2. The lighting device 1 is configured to change a state of the light source 5 according to the transmission data received from the receiver circuit 31.

The lighting system 4 with the above described configuration can transmit the transmission data from the power supply 2 to the signal receiving device 3 by changing the voltage value of the second DC voltage V2, and thus can offer a decrease in noise which is potentially caused by transmission of the transmission data. Additionally, in the lighting system 4, both the power supply 2 and the signal receiving device 3 need not include an oscillator for generating high frequency carriers, and thus circuit configuration of the power supply 2 and the signal receiving device 3 can be simplified.

As described above, the illuminating fixture 6 includes the light source 5, and the lighting device 1 configured to light the light source 5 by the second DC voltage V2 supplied from the power supply 2.

The illuminating fixture 6 with the above described configuration can reduce a time required for extinguishing an electric arc that is formed by detaching the light source 5 under the live-line state, because the voltage value of the second DC voltage V2 is decreased to the lower limit value.

As described above, the illuminating system 7 includes the lighting system 4 and the light source 5 to be lit by the lighting device 1.

Also, as described above the illuminating system 7 includes the power supply 2, and a plurality of the illuminating fixtures 6.

The illuminating system 7 with the above described configuration can reduce a time required for extinguishing an electric arc that is formed by detaching the light source 5 under the live-line state, because the voltage value of the second DC voltage V2 is decreased to the lower limit value.

Note that, if the voltage value of the second DC voltage value V2 decreases to the second voltage value V22 during the transmission period, the receiver circuit 31 of the signal receiving device 3 may wrongly determine that this second DC voltage value V22 is derived from a bit of "1". Therefore, preferably, the control circuit 23 of the power supply 2 is configured to control the voltage conversion circuit 22 so that the constant duration ΔTc during which the voltage value of the second DC voltage V2 is decreased to the second voltage value V22 does not overlap with the transmission period. However, the constant duration ΔTc may overlap with the transmission period, as long as the receiver circuit 31 can distinctively detect the third voltage value V23 from the second voltage value V22.

As described above, a power supply 2 of the first aspect is for supplying power to light a light source 5, and includes an input 20 for receiving a first DC voltage V1, an output 21 for outputting a second DC voltage V2, a voltage conversion circuit 22 configured to convert the first DC voltage V1 into the second DC voltage V2; and a control circuit 23 configured to control the voltage conversion circuit 22 to vary a voltage value of the second DC voltage V2. The control circuit 23 is configured to control the voltage conversion circuit 22 so as to decrease the voltage value of the second DC voltage V2 from a first voltage value V21 to a lower limit value (the second voltage value V22) for a predetermined duration ΔTc every time a predetermined period Tc elapses. The first voltage value V21 is equal to or greater than a voltage value necessary to keep lighting the light source 5. The lower limit value (the second voltage value V22) is smaller than the voltage value necessary to keep lighting the light source 5.

A power supply 2 of the second aspect would be realized in combination with the power supply of the first aspect. In the power supply 2 of the second aspect, the lower limit value (the second voltage value V22) equals zero.

A power supply 2 of the third aspect would be realized in combination with the power supply of the first aspect. In the power supply 2 of the third aspect, the lower limit value (the second voltage value V22) is non-zero.

A power supply 2 of the fourth aspect would be realized in combination with the power supply 2 of any one the first to third aspects. In the power supply 2 of the fourth aspect, the control circuit 23 is further configured to control the voltage conversion circuit 22 so that the second DC voltage has a voltage value (the third voltage value V23) according to transmission data in a predetermined transmission period.

A power supply 2 of the fifth aspect would be realized in combination with the power supply 2 of the fourth aspect. In the power supply 2 of the fifth aspect, the control circuit 23 is configured to control the voltage conversion circuit 22 so that the duration during which the voltage value of the second DC voltage is decreased to the lower limit value (the second voltage value V22) does not overlap with the transmission period.

A lighting system 4 of the sixth aspect includes the power supply 2 of any one of the first to fifth aspects, and a lighting device 1 configured to light the light source 5 by the second DC voltage V2 supplied from the power supply 2. The lighting device 1 includes a constant current circuit 12 configured to adjust a lighting current to be supplied to the light source 5, to a predetermined desired value.

A lighting system 4 of the seventh aspect would be realized in combination with the lighting system 4 of the sixth aspect. In the lighting system 4 of the seventh aspect, the lighting device 1 includes a first output terminal 11A to be electrically connected to a positive electrode of the light source 5, and a second output terminal 11B to be electrically connected to a negative electrode of the light source 5. The constant current circuit 23 includes a smoothing capacitor C1 electrically connected between the first and second output terminals 11A and 11B.

A lighting system 4 of the eighth aspect would be realized in combination with the lighting system 4 of the seventh aspect. In the lighting system 4 of the eighth aspect, the constant current circuit 12 includes a reverse-flow preventer (diode D1) for limiting a direction of a flow of a discharge current from the smoothing capacitor C1 so that the discharge current is outputted from the constant current circuit 12 through the first output terminal 11A and returns to the constant current circuit 12 through the second output terminal 11B.

A lighting system 4 of the ninth aspect includes the power supply 2 of the fourth or fifth aspect, a lighting device 1 configured to light the light source 5 by the second DC voltage V2 supplied from the power supply 2, and a receiver circuit 31 configured to obtain the transmission data by detecting change in the voltage value of the second DC voltage V2. The lighting device 1 is configured to change a state of the light source 5 according to the transmission data received from the receiver circuit 31.

An illuminating system 7 of the tenth aspect includes the lighting system 4 of any one of the sixth to ninth aspects, and the light source 5 to be lit by the lighting device 1.

An illuminating system 7 of the eleventh aspect includes the power supply 2 of any one of the first to fifth aspects; and a plurality of the illuminating fixtures 6 each including a light source 5 and a lighting device 1 configured to light the light source 5 by the second DC voltage V2 supplied from the power supply 2.

A method of the twelfth aspect is for reducing a time required for extinguishing an electric arc which can occur when detaching an illuminating fixture 6 from a DC power supply path under a live-line state, including: converting a first DC voltage V1 into a second DC voltage V2; supplying the second DC voltage V2 to the DC power supply path; and decreasing a voltage value of the second DC voltage V2 from a first voltage value V21 to a lower limit value (second voltage value V22) for a predetermined duration ΔTc every time a predetermined period Tc elapses. The first voltage value V21 is equal to or greater than a voltage value necessary to keep lighting a light source 5 included in the illuminating fixture 6. The lower limit value (the second voltage value V22) is smaller than the voltage value necessary to keep lighting the light source 5 included in the illuminating fixture 6.

A method of thirteenth aspect would be realized in combination with the method of the twelfth aspect. In the method of thirteenth aspect, the lower limit (the second voltage value V22) equals zero.

A method of fourteenth aspect would be realized in combination with the method of the twelfth aspect. In the method of fourteenth aspect, the lower limit (the second voltage value V22) is non-zero.

A method of fifteenth aspect would be realized in combination with the method of any one of the twelfth to fourteenth aspects. In the method of fifteenth aspect, the illuminating fixture 6 includes a constant current circuit 12 configured to adjust a lighting current supplied to the light source 5, to a predetermined desired value. The constant current circuit 12 includes a DC/DC converter which converts the second DC voltage V2 supplied to the DC power supply path to a DC voltage applied to the light source 5. When the second DC voltage V2 is decreased to the lower limit value (the second voltage value V22), the converted DC voltage supplied by the DC/DC converter to the light source 5 is insufficient to light the light source 5.

An illuminating fixture 6 of the sixteenth aspect includes a light source 5, and a lighting device 1 configured to light the light source 5 by the second DC voltage V2 supplied from the power supply 2 of any one of the first to fifth aspects.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A power supply for supplying power to light a light source, comprising:

an input for receiving a first DC voltage;

an output for outputting a second DC voltage;

a voltage conversion circuit configured to convert the first DC voltage into the second DC voltage; and a control circuit configured to control the voltage conversion circuit to vary a voltage value of the second DC voltage, the control circuit being configured to control the voltage conversion circuit to decrease the voltage value of the second DC voltage from a first voltage value to a lower limit value for a predetermined duration every time a predetermined period elapses, and the first voltage value being equal to or greater than a value necessary to light the light source, and the lower limit value being a value insufficient to light the light source.

2. The power supply of claim 1, wherein the lower limit value equals zero.

3. The power supply of claim 1, wherein the lower limit value is non-zero.

4. The power supply of claim 1, wherein the control circuit is further configured to control the voltage conversion circuit so that the second DC voltage has a voltage value which changes according to transmission data in a predetermined transmission period.

5. The power supply of claim 4, wherein the control circuit is configured to control the voltage conversion circuit so that the duration during which the voltage value of the second DC voltage is decreased to the lower limit value does not overlap with the transmission period.

6. A lighting system, comprising:

the power supply of claim 1; and a lighting device configured to light the light source by the second DC voltage supplied from the power supply, the lighting device including a constant current circuit configured to adjust a lighting current to be supplied to the light source, to a predetermined desired value.

7. The lighting system of claim 6, wherein:

the lighting device includes a first output terminal to be electrically connected to a positive electrode of the light source, and a second output terminal to be electrically connected to a negative electrode of the light source; and the constant current circuit includes a smoothing capacitor electrically connected between the first and second output terminals.

8. The lighting system of claim 7, wherein the constant current circuit includes a reverse-flow preventer for limiting a direction of a flow of a discharge current from the smoothing capacitor so that the discharge current is outputted from the constant current circuit through the first output terminal and returns to the constant current circuit through the second output terminal.

9. A lighting system, comprising:

the power supply of claim 4;

a lighting device configured to light the light source by the second DC voltage supplied from the power supply; and a receiver circuit configured to obtain the transmission data by detecting change in the voltage value of the second DC voltage, the lighting device being configured to change a state of the light source according to the transmission data received from the receiver circuit.

10. An illuminating system, comprising:

the lighting system of claim 6; and the light source to be lit by the lighting device.

11. An illuminating system, comprising:

the power supply of claim 1; and a plurality of the illuminating fixtures, each including:

a light source; and a lighting device configured to light the light source by the second DC voltage supplied from the power supply.

12. A method for reducing a time required for extinguishing an electric arc which can occur when detaching an illuminating fixture from a DC power supply path under a live-line state, comprising:

converting a first DC voltage into a second DC voltage;

supplying the second DC voltage to the DC power supply path; and decreasing a voltage value of the second DC voltage from a first voltage value to a lower limit value for a predetermined duration every time a predetermined period elapses, and the first voltage value being equal to or greater than a value necessary to light a light source included in the illuminating fixture, and the lower limit value being a value insufficient to light the light source included in the illuminating fixture.

13. The method according to claim 12, wherein the lower limit value equals zero.

14. The method according to claim 12, wherein the lower limit value is non-zero.

15. The method according to claim 12, wherein the illuminating fixture includes a constant current circuit configured to adjust a lighting current supplied to the light source, to a predetermined desired value, the constant current circuit including a DC/DC converter which converts the second DC voltage supplied to the DC power supply path to a DC voltage applied to the light source, and wherein when the second DC voltage is decreased to the lower limit value, the converted DC voltage supplied by the DC/DC converter to the light source is insufficient to light the light source.

* * * * *